United States Patent [19]

Kotyuk

[11] 4,120,400

[45] Oct. 17, 1978

[54] PILL PACKAGE

[75] Inventor: Bernard Kotyuk, Glendale, N.Y.

[73] Assignee: Primary Design Group, Inc., New York, N.Y.

[21] Appl. No.: 743,822

[22] Filed: Nov. 22, 1976

[51] Int. Cl.[2] ..... B65D 85/56

[52] U.S. Cl. ..... 206/528; 206/1.5; 206/468; 229/19; 229/9; 220/346

[58] Field of Search ..... 206/528, 468, 45.15, 206/267, 39.5, 1.5; 229/175 C, 19, 20, 9, 10, 11; 220/346, 347, 351, 323, 324, 326, 322

[56] References Cited

U.S. PATENT DOCUMENTS

| | | | |
|---|---|---|---|
| B 536,923 | 3/1976 | Mayled | 229/19 |
| 3,504,788 | 4/1970 | Gray | 229/10 |
| 3,741,387 | 6/1973 | Whitecar | 229/19 |
| 3,987,891 | 10/1976 | Horvath | 220/347 |

FOREIGN PATENT DOCUMENTS

| | | | |
|---|---|---|---|
| 446,174 | 3/1968 | Switzerland | 229/20 |

*Primary Examiner*—William Price
*Assistant Examiner*—Joseph Man-Fu Moy
*Attorney, Agent, or Firm*—Wolder, Gross & Yavner

[57] ABSTRACT

A pill package of the type including child-proof features makes use of the standard blister card for mounting the pills. A plastic shield is constructed to provide a slidable mating relationship with the blister card in an unlocked position and the card and shield together defining locking means wherein both locked and unlocked positions can be assumed between the card and shield. As in all conventional blister cards, an access means construction is included, but in the structure of the present invention, the access means is unexposed when the card and shield are in the locked position.

4 Claims, 26 Drawing Figures

10
12
14
16
18
20
22
24
26
28
30
32
36
38
40
42
3
4

90
92
94
96
98
100
101
102
104
106
108
110
112
114
116
122
122'
130
16
19
20
21

PILL PACKAGE

BACKGROUND OF THE INVENTION

This invention relates primarily to pill packages and, more particularly to pill packages of the child-proof type, wherein a blister card having access means is provided with such means hidden from view when the package is in the closed or locked position.

The child-proofing of pill packages in an oft-explored art in present day technology. Since the advent of a pill-oriented society during the past generation, it has become increasingly important to enable easy access by means of pill package constructions for people whose use of such pills is warranted. More importantly, it has become increasingly important to prevent access to pills by protecting children from accidental or intentional use by means of a pill package structure which conveniently enables warranted use but prevents unwarranted use.

Specifically, there are three general philosophies for preventing child tampering with pill packages, firstly, there is the concept of hiding the direct access means for the pills from view unless and until the package access means are operated; secondly, there is the concept of providing the package with access means or unlocking means which require a force greater than that which is within a child's capability; and, thirdly, there is the concept of providing a dexterity threshhold for opening the package which is beyond the child's capabilities.

Various pill package structures have attempted the use of one or two of these concepts to prevent child tampering with a pill package. Most such attempts have resulted in either successful child-proofing of the package coupled with a significant inconvenience to the adult user or have been unsuccessful in preventing child tampering.

For instance, a popular child-proof packaging assembly in present day technology includes a typical pill bottle with a plastic cap which must be depressed before it is rotated. For an adult community which grew up with the teaching that a cap unscrews simply by counterclockwise rotation, such an embodiment has not only succeeded in preventing child tampering but has also succeeded in adding to the frustrations of the present day adult society. More specifically, the use of a plastic cap which must be depressed before it is turned to loosen it, has served merely to prevent convenient adult use as it accomplishes its objective to prevent child tampering. Still further, such a package embodiment has also served to make contamination of the contents more likely since replacing the cap after use has included a means by which the adult population has protected itself from future frustrations; i.e., the adults replacing the cap in a manner which defeats the child-proof construction in order to make pill access more convenient for the adult in future use. Such manifestations of adult resistance to such child-proof packages therefore defeats the child-proofing aspects of the construction. Also, improper replacement of the plastic cap leads to contamination of the pills in the package.

SUMMARY OF THE INVENTION

Accordingly, a primary object of the present invention is to provide a child-proof package which prevents child tampering and yet is convenient for warranted use by an adult.

A further object of the present invention is to provide a child-proof package which combines the various concepts of child-proofing heretofore attempted in a novel, yet efficient and convenient package structure.

A still further object of the present invention is to provide a child-proof package for use combination with a standard blister sub-package which is capable of assuming both locked and unlocked position.

Still another object of the present invention is to provide a child-proof package which is used in combination with a standard blister package and which hides the direct access means for the blister package while the package is in its locked position.

Another object of the present invention is to provide a child-proof package which assumes both locked and unlocked positions in a manner to exceed the dexterity and force capability of a child while providing efficient and convenient access by an adult.

These and other objects of the present invention are accomplished in a preferred embodiment of the present invention which features a standard blister card for enclosing pills or tablets and a shield for encircling the blister card. The card and shield together define locking means by which the package assumes both locked and unlocked positions. The blister card and shield are constructed to provide a slidable mating relationship between them when they are in unlocked position and a child-proof relationship when they are in locked position. Furthermore, the tablet or pill blister card includes direct access means which are unexposed when the locked position between the blister card and shield is assumed.

Specifically, the locking means includes at least one lock member tab extending from the blister card and a lock receptacle opening defined by the shield. The shield has a lock shoulder extending into the lock receptacle opening and the tab defines a locking notch for mating with the shoulder upon insertion of the tab through the lock receptacle opening to establish a locked position. Motion of the tab to a remote position removes the shoulder from the notch to establish a slidable and unlocked relationship between the blister card and the shield.

In a first alternative embodiment, a pair of lock receptacle openings are defined by the shield and the blister card includes a pair of mating tabs. The lock receptacle openings are separated to provide a dexterity threshhold above that within the capability of the child. Of course, with both the previously mentioned embodiments and all alternative embodiments, the force capability of the child is exceeded in terms of breaking the package to avoid operation of the child-proof locking means and the shield is substantially totally encircling with respect to the blister card.

Still another embodiment of the present invention includes a generally flattened cylindrically shaped plastic shield including sides and a top wherein a lock member elongated rail downwardly depends from the top of the shield for mating relationship with an elongated lock receptacle track defined by the blister card. The track has a pair of ends, each of which functions as an end stop to establish a locking position for the package when the blister card is fully inserted into the shield.

Another alternative embodiment of the present invention includes a generally U-shaped shield defining a U-shaped sliding track for slidable mating with a folded blister card. The folding of the blister card serves to substitute for the totally encircling shield to hide the blister card direct access means when the package is in a locked position. Specifically, a typical blister card includes openings and a plastic blister envelope on one side thereof with the blister envelope defining pockets for the pills or tablets. When the pills or tablets are inserted through the openings, they are held partially by the pockets and more substantial by a foil cover which is attached at the edge of the other side of the blister card from the blister envelope so that a two-sided holding structure is provided for the pills. Direct access for the pills is enabled by providing the foil cover of a material which is easily perforated or scored to be perforated easily. Thus, by folding the blister card so that the foil of half the package is placed in contact with the foil of the other half of the package, the direct access means for the pills is unexposed.

In this last embodiment, the folded blister package defines a pair of lock receptacles for mating relationship with a pair of lock member tabs extending from the U-shaped shield. Furthermore, the shield and card together define stop means in the form of a pair of L-shaped shoulders so that the blister card cannot be conveniently completely removed from the U-shaped shield track. Accordingly, a pair of score lines are defined by the blister card near the fold thereof to enable opening of the blister card to expose the direct pill access means for use when the package is in its unlocked position.

Other objects, features and advantages of the present invention will become apparent from the following more detailed description of a preferred and alternative, yet nonetheless illustrative, embodiment of the present invention with reference to the accompanying drawings, wherein:

DESCRIPTION OF THE EMBODIMENTS

Figures 1, 2, 4:
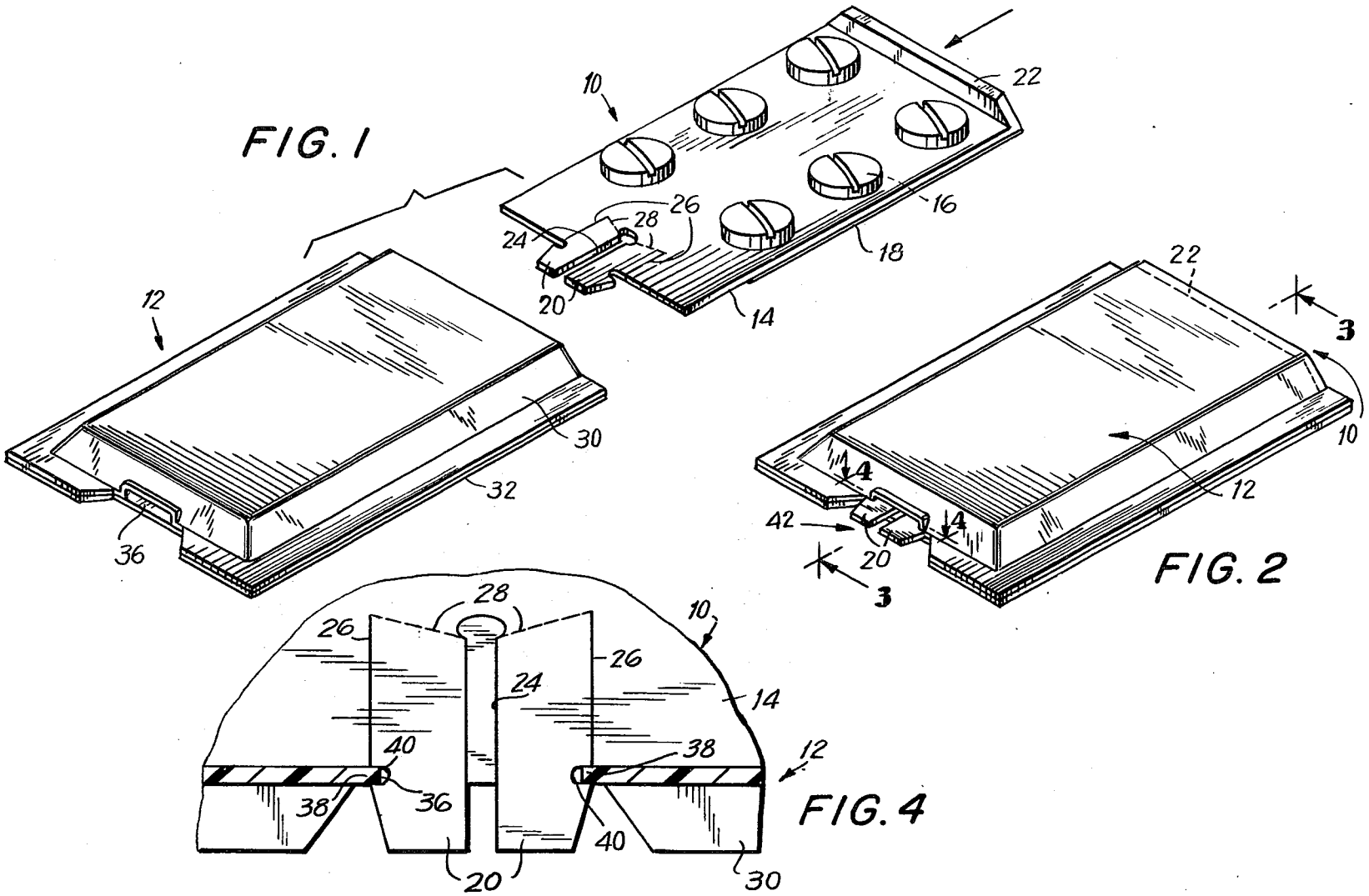
FIG. 1 is an exploded isometric view of a preferred embodiment of the present invention showing particularly the unlocked position thereof.
FIG. 2 is an isometric view of the package of FIG. 1, but illustrating particularly the locked position and contamination shield for the package.
FIG. 4 is a partial top sectional view of the package of FIG. 2, taken along the line 4—4 thereof, and showing particularly the locking means thereof including the lock receptacle opening of the shield, the locking shoulders extending therefrom and the tabs defining locking notches therein.
Figure 3:
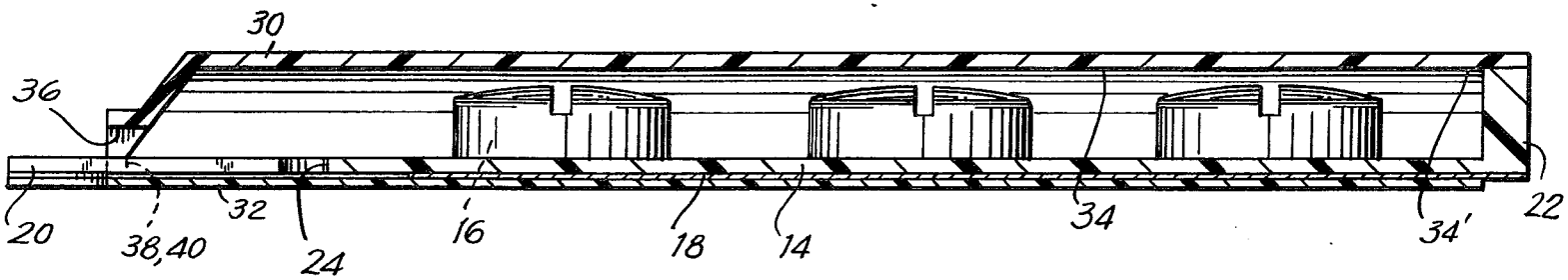
FIG. 3 is a side sectional view, taken along the lines 3—3 of FIG. 2.

The present invention in all its embodiments, features a blister card for enclosing the tablets or pills with the card being encircled by a shield. The card and shield together define positive locking means including a lock receptacle and a lock member for assuming locked and unlocked positions. The card is slidable relative to the shield when the locking means is in an unlocked position and the card and shield, when in the locked position for the locking means, cannot be easily unlocked by a child, even though they may then be conveniently and efficiently unlocked by an adult.

Referring to the drawings, a blister card, generally designated 10, and a card-encircling shield, generally designated 12, are shown in FIGS. 1–5 to form the main structural portions for the preferred embodiment of the present invention. More particularly, blister card 10 comprises a baseboard 14 coated with a medium weight plastic which is vacuum formed to define a plastic blister over pills or tablets 16. Foil material 18 or the like coats the underside of baseboard 14 in a manner conventionally used for blister card packaging of pills or tablets. In the present invention, blister card 10 additionally includes tabs 20 which extend forwardly of blister card baseboard 14. Furthermore, upstanding contamination closure member 22 extends from baseboard 14 to perform a function to be described hereinafter. Even more specifically, blister card 10 is formed by a die-cut or other conventional plastic working process to include bifurcation 24 defined by baseboard 14 and further includes cuts 26 and score lines 28 to enable the motion of tabs 20 to a remote position more proximate to each other relative to the position shown in FIGS. 1, 2 and 4. Motion to such a remote position will be described in this specifically with reference to FIG. 5 in order to provide a fuller understanding of the unlocking mechanism.

Shield 12 is designed generally to encircle blister card 10 and includes a top body member 30 and a bottom body member 32. The two body members 30, 32 are molded of plastic or other suitable material to form a blister card opening 34 (FIG. 3) to encircle blister card 10. Entrance opening 34' enables insertion of card 10. Shield 12 defines lock receptacle opening 36 at its forward end, which together with tabs 20, form the locking means for the present invention.

The locking means in particular, are shown in FIG. 4 wherein bifurcation 24 is defined by tabs 20 and cuts 26 are defined by the baseboard 14 and tabs 20 to enable motion of tabs 20 to operate the locking means. Correspondingly, top body member 30 includes shoulders 38 extending into lock receptacle opening 36 and tabs 20 define locking notches 40 to establish a locking structure between blister card 10 and shield 12. The normal position for the locking means mates shoulders 38 with locking notches 40 and bifurcation 24 open to its fullest extent. Score lines 28 and the medium weight plastic overlying baseboard 14 cooperate to provide a needed stiffness for tabs 20 while providing a needed flexibility for operation of locking means 42 (FIG. 2) in the structure of the present invention.

Figure 5:
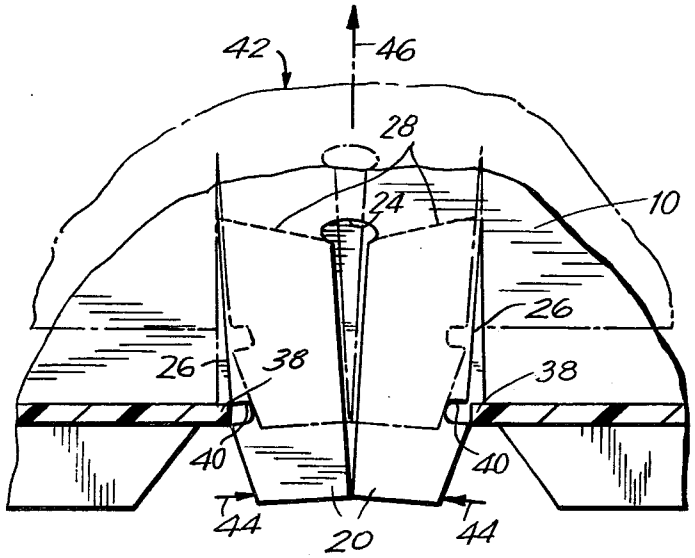
FIG. 5 is a view similar to that shown in FIG. 4, but illustrating particularly the unlocking or releasing motion for the locking means.

Referring specifically to FIG. 5, the operation of locking means 42 will now be described. Beginning with the rest or locked position shown in FIG. 4, the release or unlocking motion is accomplished by pinching tabs 20 together toward a remote positon proximate each other in directions designated by arrows 44. Such motion removes notches 40 from shoulders 38 and enables withdrawal of blister card 10 in a direction shown by arrow 46. Ghost lines depicted by FIG. 5 illustrate the sliding motion and position attainable by operation of locking means 42 as illustrated and described.

Figure 6:
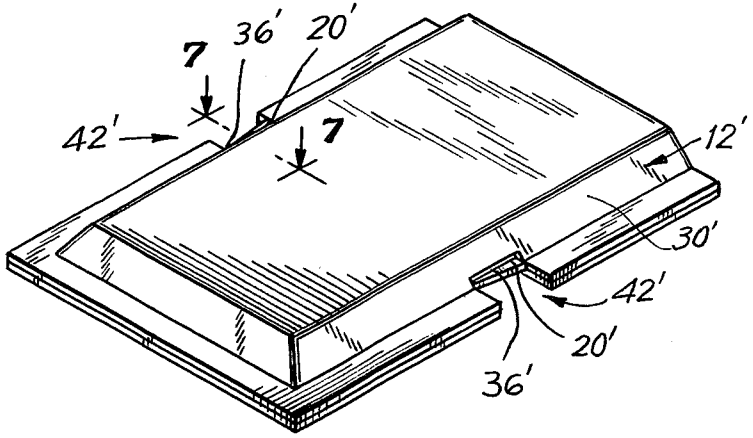
FIG. 6 is an alternative embodiment of the present invention shown in isometric view with locking means including a pair of side-positioning separated tabs and a pair of separated locking receptacle openings.
Figure 8:
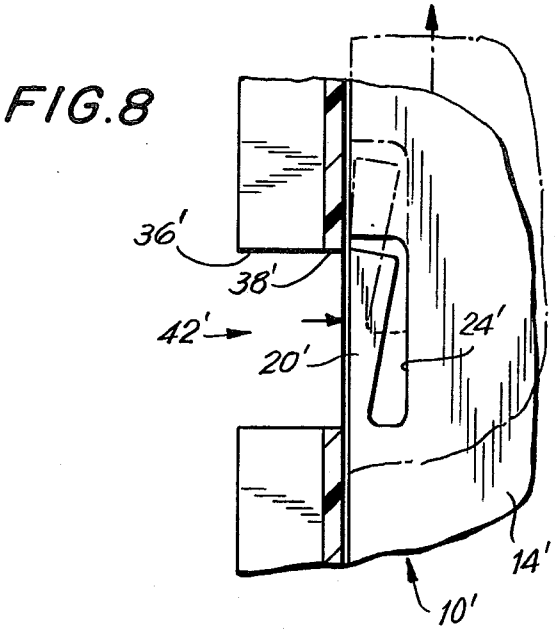
FIG. 8 is a view similar to that of FIG. 7, but illustrating the unlocking or releasing motion for the locking means.
Figure 7:
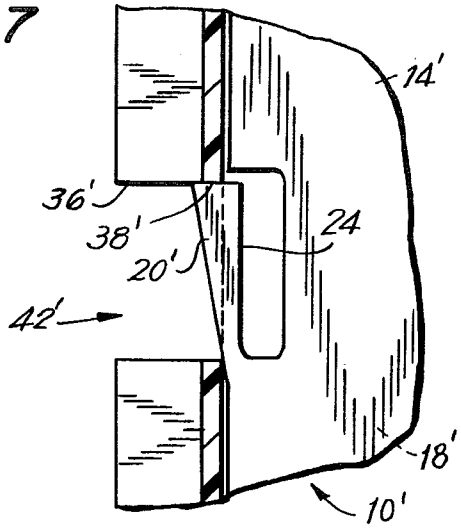
FIG. 7 is a partial top sectional view taken along the line 7—7 of FIG. 6 and showing particularly the mating relationship between a locking receptacle opening and a locking member tab.

FIGS. 6–8 illustrate a modification of the preferred embodiment wherein top body member 30' is provided with lock receptacle openings 36' at its sides rather than at its forward end, as described with reference to the preferred embodiment. Likewise, tabs 20' are positioned at the sides of blister card baseboard 14' rather than at the forward end, as shown with reference to the preferred embodiment. In this way, the locking means 42' includes an additional safeguard for obtaining child-proof operation. Specifically, with reference to FIGS. 6–8, it may be seen that the separation of locking means 42' requires additionally the dexterity of handling separated locking means in a coordinated time period and further requires a hand span capability between thumb and forefinger that is beyond a child's physical endowment. Thus, by moving tabs 20' toward each other into bifurcation 24' such tabs are removed from shoulder areas 38' extending into lock receptacle openings 36'.

As with the preferred embodiment, the same concepts of structure are used in FIGS. 6–8 to construct the pill package; that is, a blister card is encircled by a shield, which together define positive locking means including a lock receptacle 36' and a lock member 20'. Locking means 42' assumes both locked and unlocked positions, with baseboard 14' being slidable with respect to shield 12' when the unlocked position is attained. Also, in both cases, the foil underside 18' of blister card 10' is unexposed when the blister card is in locked position with respect to shield 12'. In other words, not only must the pill package be unlocked to obtain access, but also direct access to pills 16 is only attained after foil 18 is broken by pushing down on the top side of blister card 10' above the position of pills 16.

Figure 10:
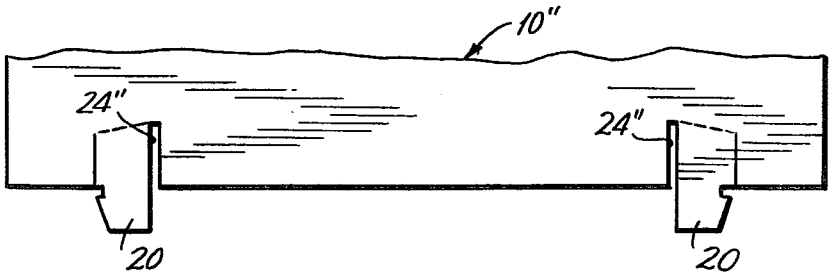
FIG. 10 is an alternative embodiment similar to the embodiments illustrated in FIGS. 1–5 and 9, but with separated front-facing tabs to exceed the dexterity and span capability of a child.
Figure 9:
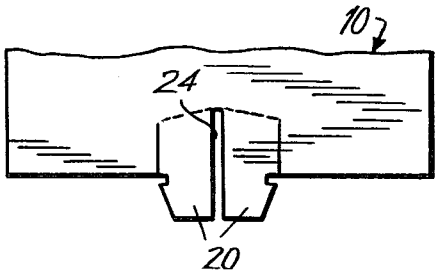
FIG. 9 is a partial view of the blister card of the present invention, illustrating the structural adjustment made for constructing the alternative embodiment shown in FIG. 10.

A slightly modified version of the embodiments of the FIGS. 6–8 is illustrated by means of FIGS. 9 and 10. FIG. 9 illustrates the preferred form of blister card 10 with tabs 20 in close association with each other and separated only by bifurcation 24. The modified version of FIG. 10 separates tabs 20, with each having a respective bifurcation 24''. Thus, the embodiment of FIG. 10 includes a blister card 10'' wherein tabs 20 are incorporated in a modification using the separation concept of FIGS. 6–8 and with the forward tab concept of FIGS. 1–5. The dexterity of release timing as well as the span capability requirements are together imposed within the structurally preferred forward tab concept of FIGS. 1–5.

FIGS. 11–16 illustrate still another embodiment wherein a blister card, generally designated 50, is associated with a modified shield, generally designated 52. Shield 52 defines sides 54, a top 56 and a bottom 58 which together form a flattened generally cylindrical shield enclosure. Downwardly depending from top 56 is a rail 59 extending from one end of shield 52 to the other.

Correspondingly, blister card 50 includes plastic enveloped pills 16 symmetrically dispersed at either side of a track 60 which fits over rail 59. Forward end 62 of track 60 and rear end 64 of track 60 together form a stop means with rail 59 when the package is in locked position. Also, blister card 50 defines unlocking surfaces 66 by which the unlocking motion is enabled by this embodiment. Still further, blister card 50 defines hanging opening 68 by which the pill package may be suspended for storage as on a nail, hook or the like (not shown).

Figure 12:
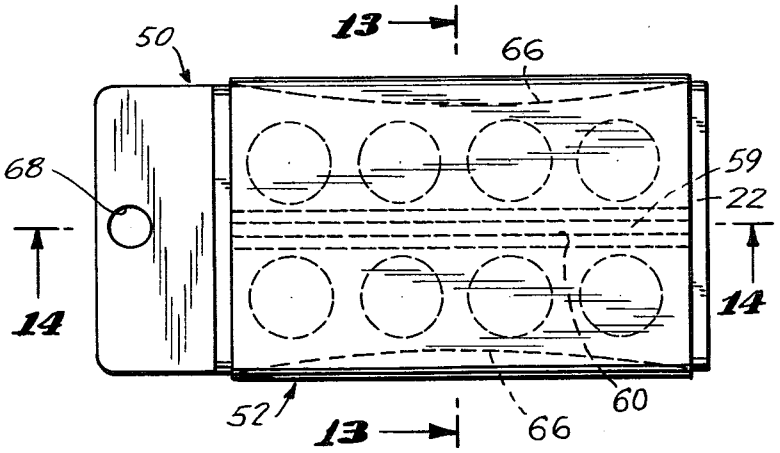
FIG. 12 is a top view of the embodiment of FIG. 11 showing particularly the side unlocking surfaces for the blister card which enables convenient unlocking motions as hereinafter described with reference to FIGS. 15 and 16.

FIG. 12 shown the locked position wherein rail 59 is conveniently inserted to track 60 with stops 62, 64 engaged. It may be seen that a contamination closure member 22' is provided for blister card 50. This contamination closure member (as with contamination closure member 22 of FIG. 2) prevents contamination by means of dust entering the package during storage or the like. A similar concept is employed for the preferred and other alternative embodiments of this invention.

Figure 11:
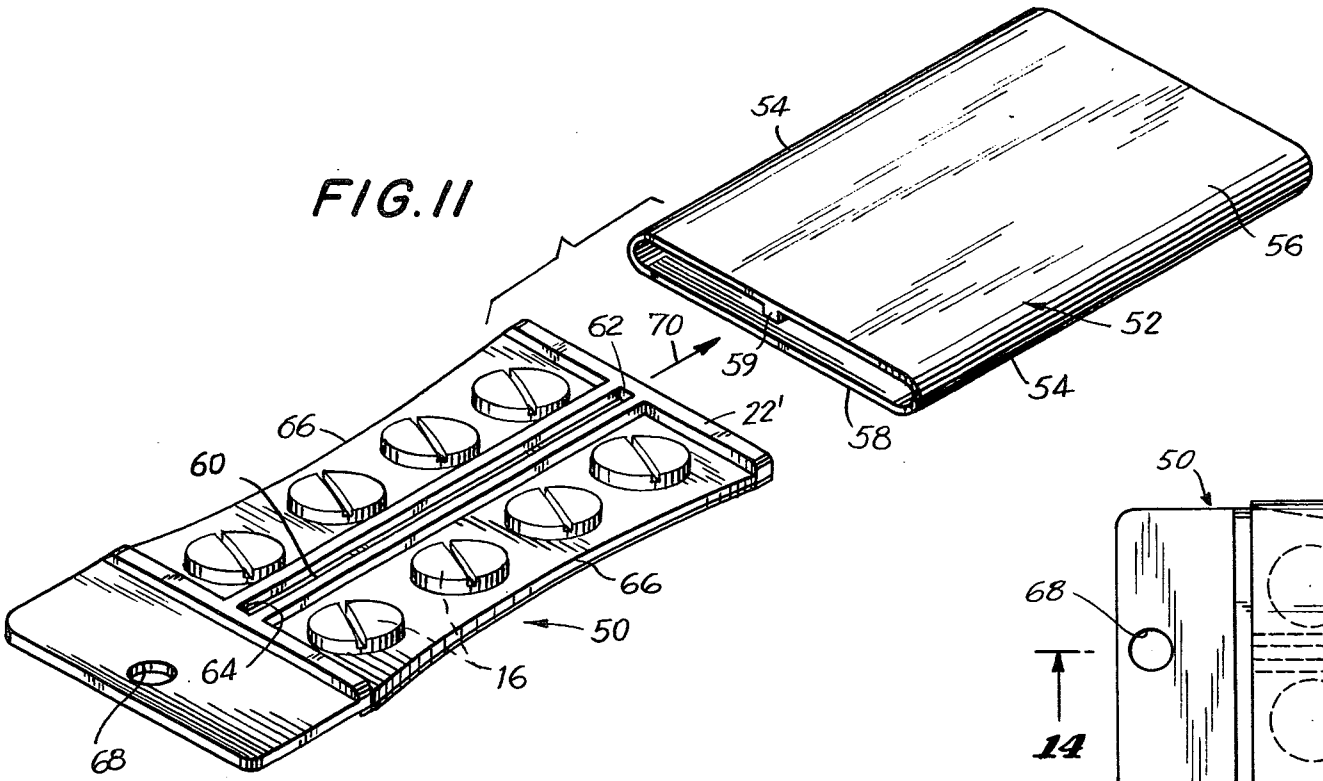
FIG. 11 is a further alternative embodiment of the present invention in isometric view and showing particularly a locking means including a rail and a track having end stops for the rail.
Figure 13:
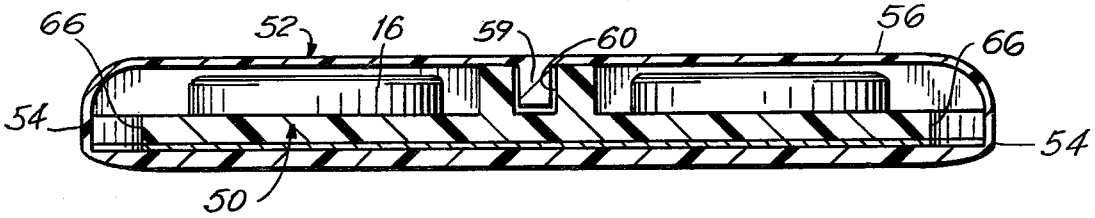
FIG. 13 is a front sectional view taken along the line 13—13 of FIG. 12.

The storage position of FIGS. 12 and 13 (the locked position) is obtained by sliding blister card 50 within shield 52 in the direction of arrow 70 (FIG. 11). The slidable relationship obtains until rail 59 seats within track 60 and stop means 62, 64 limit further motion.

Figure 14:
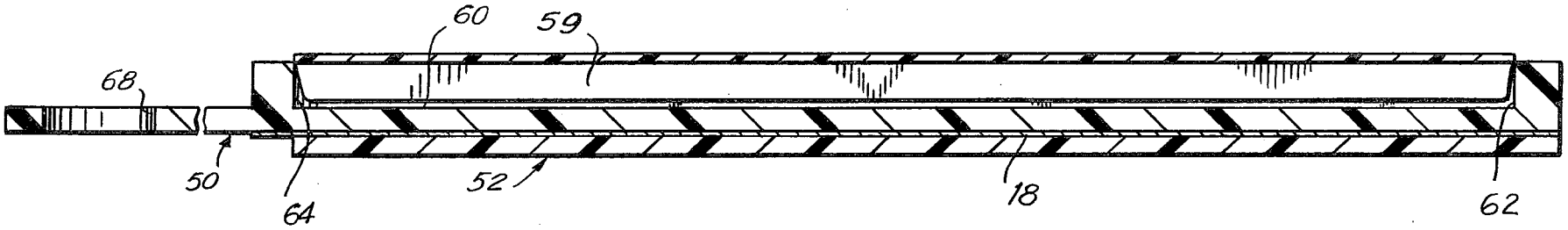
FIG. 14 is a side sectional view taken along the line 14—14 of FIG. 12.
Figure 15:
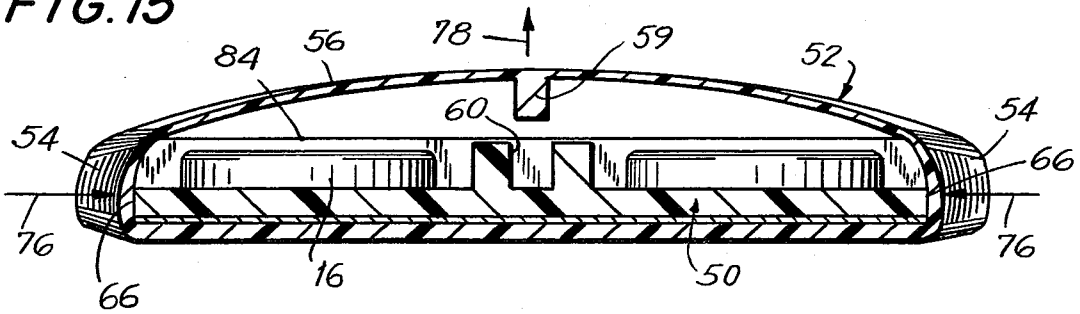
FIG. 15 is a front sectional view similar to that of FIG. 13, but illustrating the unlocking motion for the package.
Figure 16:
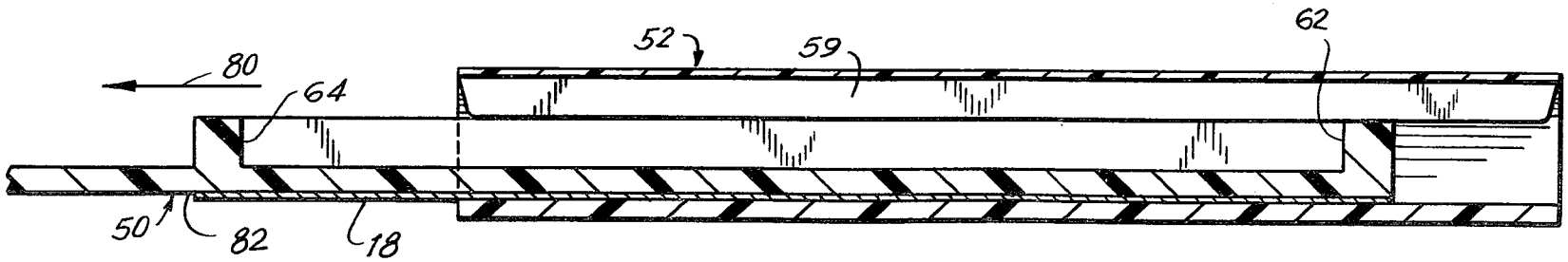
FIG. 16 is a further side sectional view of the alternative embodiment of FIGS. 11–15 and similar to that shown in FIG. 14, but with the blister card partially removed and in slidable relationship with the shield of the package after unlocking motion according to FIG. 15.

The locked position is even more clearly depicted in FIG. 14, and this locked position can be assumed as the starting position for the purposes of describing unlocking or release motion with reference to FIGS. 15 and 16. The first step in the unlocking motion involves together pressing unlocking surfaces 66 by applying pressure to sides 54 of shield 52 in directions depicted by arrows 76. Since shield 52 is extruded from medium soft plastic, downward pressure normally exists on top 56 to keep rail 59 within track 60. The pressure just described at the sides of shields 54 serves to lift top 56 in a direction depicted by arrow 78 in FIG. 15. This release rail 59 from track 60 which, in turn enables sliding motion of the blister card 50 relative to shield 52 in a direction shown by arrow 80 in FIG. 16. This exposes foil 18 on the removal surface 82 defined at the underside of blister card 50 in this and all the other embodiments. Thus, by pressing on the exposure surface 84 (FIG. 15), on the top side of blister card 50, over pills 16, foil 18 can be broken to obtain direct access to the pills or tablets.

At this juncture, it should be understood that the foil may be scored or otherwise weakened just below each pill 16 in order to facilitate the direct access to pills or tablets discussed herein.

A final embodiment of the present invention is presented in FIGS. 17–26 wherein a blister card, generally designated 90, is associated with a U-shaped shield track, generally designated 92. Blister card 90 includes a folded baseboard 94 which bends at fold lines 96. Foil 98 coats the major part of removal surface 100 defined by baseboard 94 and a vacuum formed envelope 102 overlies pills 16 on the exposure surface 101 also defined by baseboard 94.

Correspondingly, U-shaped shield track 92 can be formed of two parts 106, 108 which are mated to define sliding track 110. Each leg of the U-shape includes extended tabs 112 for fitting into lock receptacle openings 114 defined by baseboard 94 of blister card 90.

Figures 17, 18, 19:
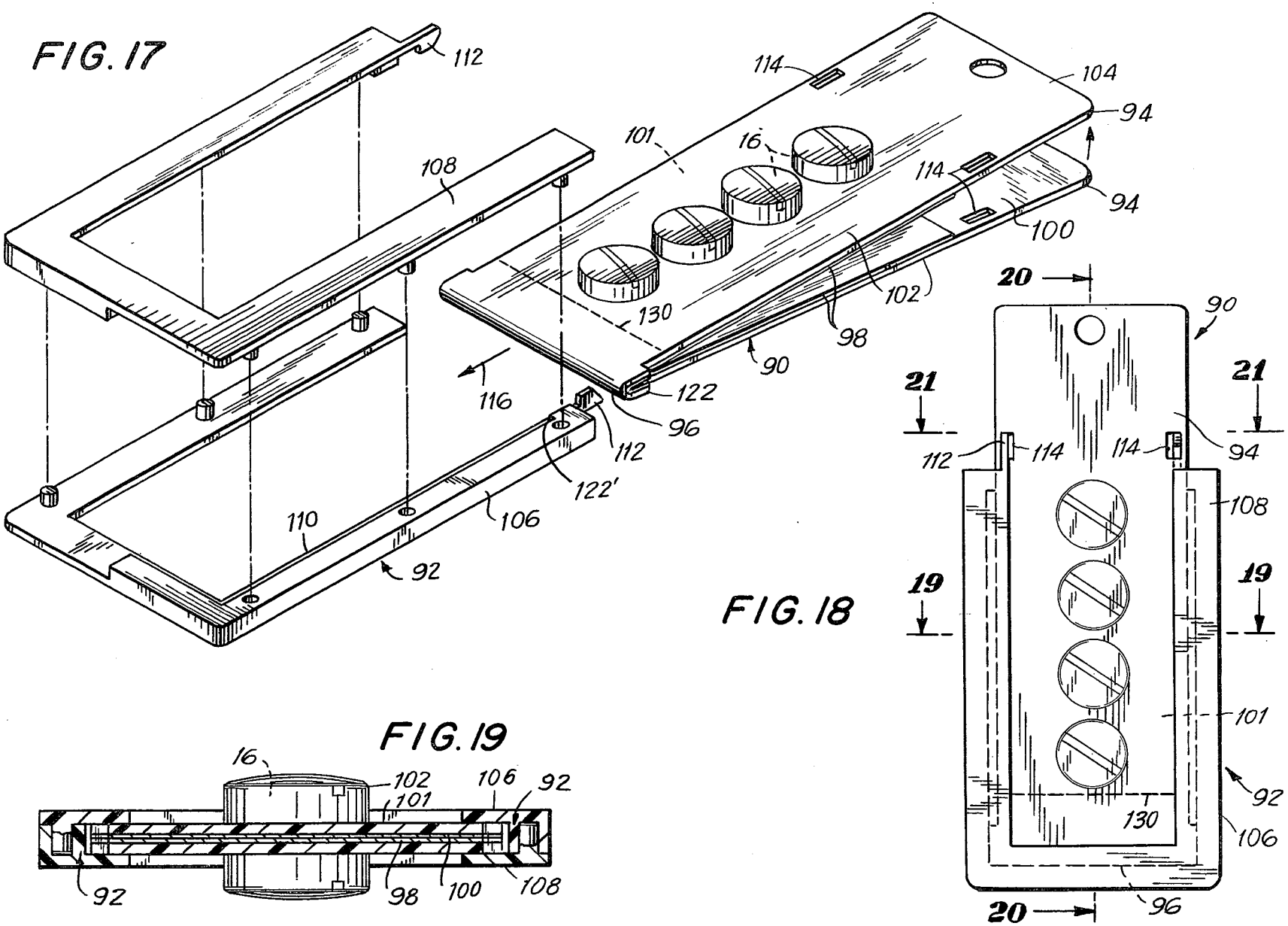
FIG. 17 is an exploded isometric view of another alternative embodiment, showing particularly a folded blister card and a U-shaped shield track for mating relationship therewith.
FIG.18 is a top view of the embodiment of FIG. 17, but with the blister card and U-shaped shield track in locked or closed relationship.
FIG. 19 is a back sectional view taken along the line 19—19 of FIG. 18.
Figure 20:
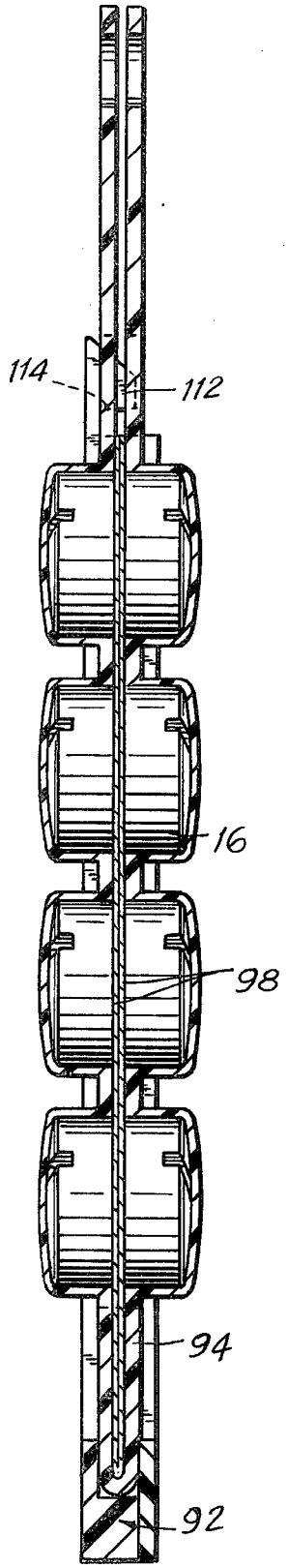
FIG. 20 is a side sectional view taken along the line 20—20 of FIG. 18.
Figure 21:
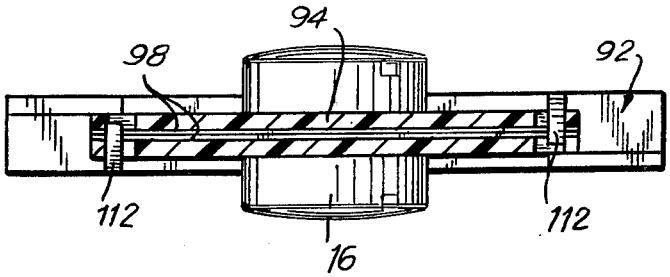
FIG. 21 is a further back sectional view taken along the line 21—21 of FIG. 18.
Figure 22:
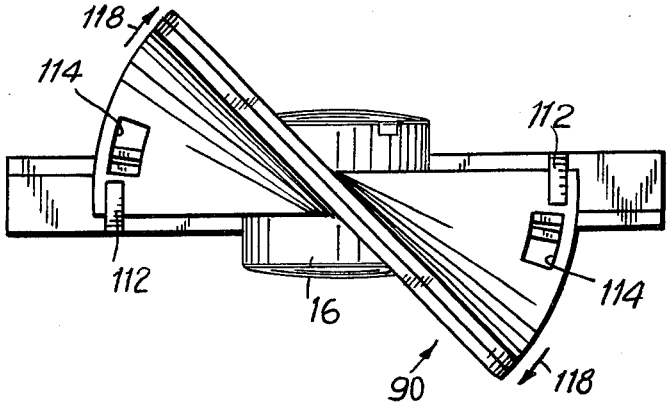
FIG. 22 is a back view of the embodiment of FIGS. 17–21 but with the blister card twisted to illustrate the first step in unlocking or opening the package.
Figure 23:
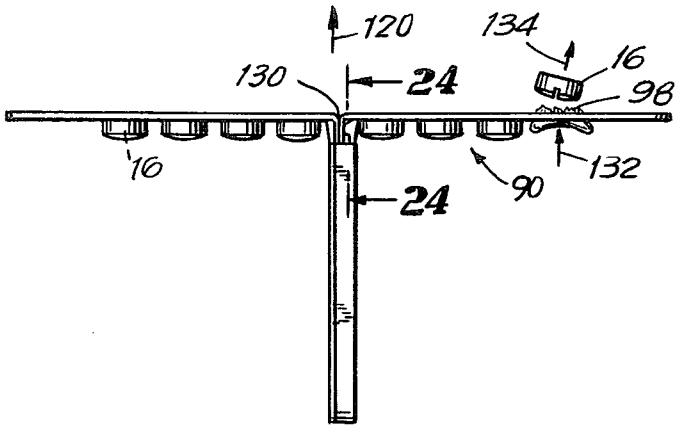
FIG. 23 is a side view of the embodiment of FIGS. 17–22, but illustrating particularly the last step of opening the package to obtain direct access to the pills.
Figure 24:
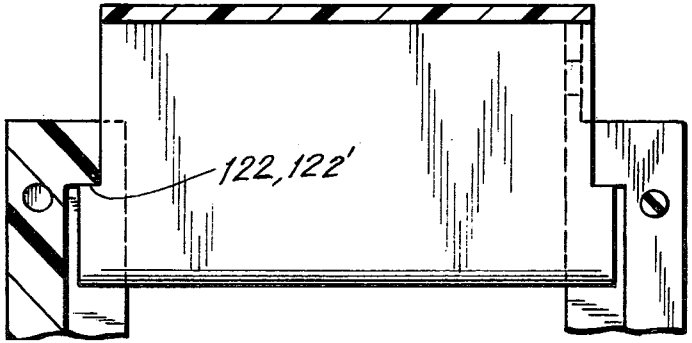
FIG. 24 is a partial sectional view of the embodiment of FIGS. 17–23 taken along the line 24—24 of FIG. 23 and illustrating particularly the relative positon of blister card and U-shaped shield track during the last step of opening the package with the stop means thereof in effect.

In the exploded view of FIG. 17, arrow 116 depicts the direction in which blister card 90 is slid in order to engage blister card 90 and sliding track 110. The locked or engaged package is then shown in FIGS. 18–21. The release or unlocking operation is depicted in FIG. 22 wherein a clockwise twisting of blister card 90 in directions depicted by arrows 118 accomplishes the removal of tabs 112 from lock receptacle openings 114. Blister card 90 is then moved in the direction depicted by arrow 120 (FIG. 23) to a position where cooperating stops 122, 122' defined by blister card 90 and U-shaped shield track 92, respectively, engage ( FIG. 17, 24). Scored lines 130 are provided near fold line 96 in each of the folded portions of baseboard 94 (FIG. 17) to provide a final step opening capability for blister card 90, as shown in FIG. 23. FIG. 23 also serves to illustrate the direct access means for pills 16 wherein the blister card is pushed in direction 132 to force pills 16 through foil 98 in a direction depicted by arrow 134.

Figure 25:
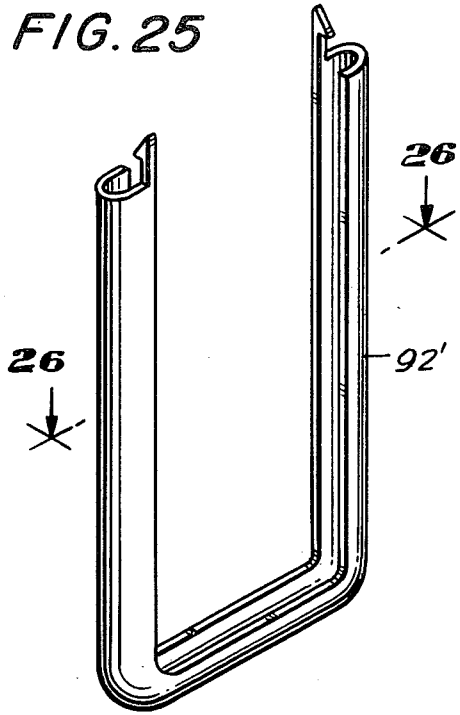
FIG. 25 is an isometric view of the U-shaped shield track of the embodiment of FIGS. 17–24 in a slightly modified form.
Figure 26:
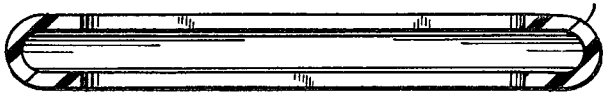
FIG. 26 is a rear sectional view of the U-shaped shield track of the modified form of FIG. 25, taken along the line 26—26 of FIG. 25.

A slightly modified molded form of U-shaped shield track 92' is shown in FIGS. 25 and 26. This embodiment of shield track 92' illustrates the simplified molded construction that can be used in a one-piece structure for the present invention, as distinguished from the two-piece track depicted in FIG. 17.

In order to provide even more understanding of the present invention, a series of use and operational steps will now be described as common to all embodiments of the present invention.

A blister card is encircled by a shield, and the shield and blister card together provide locking means by which a positive engagement capability is enabled between such elements. One of the shield and card provides an extension which fits into an opening provided by the other to define the engagement. During engagement or locking, the blister card removal surface in the form of a foil seal is hidden from view and view of the removal surface in the form of a blister cover for the pills is obtained only after unlocking and sliding the blister card relative to the shield. Unlocking is accomplished by a predetermined motion of the locking means which disengages the card relative to the shield to enable sliding of the card and direct access to the pills through the foil.

A child-proof pill package is thereby accomplished which is convenient and efficient with respect to both adult operation and yet which is beyond the dexterity, force and viewing capability of the child.

What is claimed is:

1. A child-proof tablet package for holding tablets comprising a shield member and a card member, said card member including means for receiving said tablets, said shield member having two ends, one end for receiving and removing said card member and the other end defining a lock receptacle opening, said card member further including a pair of locking tabs intergral with said card member and extending beyond one end thereof, each of said tabs hinged to card member by scored lines and including a locking notch at its side edge, wherein said locking notch engages said shield member at said opening for establishing a locked position with respect to said card member and said shield member.

2. The invention according to claim 1 wherein said card member includes direct access means for said tablets, said direct access means being unexposed when said card member is within said shield member in a locked position.

3. The invention according to claim 1 wherein said shield member has a locking shoulder extending into said opening, said tabs being movable to a remote position for establishing an unlocked position and normally at a rest position with said shoulder extending into said locking notch and with said tabs extending through said opening for establishing a locked position.

4. The invention according to claim 1 wherein a pair of said tabs is provided for said card member and said shield member defines a pair of lock openings and has a pair of locking shoulders, one extending into each opening.

* * * * *